US005697268A

United States Patent [19]

Makovsky et al.

[11] Patent Number: 5,697,268

[45] Date of Patent: Dec. 16, 1997

[54] WING NUT DRIVER

[76] Inventors: Keith A. Makovsky, 2155 NW. 76 Way; Joseph J. Kavanagh, 7695 NW. 21 Ct., both of Margate, Fla. 33063

[21] Appl. No.: 627,135

[22] Filed: Apr. 3, 1996

[51] Int. Cl.[6] ..... B25B 13/02

[52] U.S. Cl. ..... 81/125; 81/124.2; 81/176.15; 81/901

[58] Field of Search ..... 81/121.1, 124.2, 81/124.6, 176.15, 176.2, 901, 125

[56] References Cited

U.S. PATENT DOCUMENTS

| | | | |
|---|---|---|---|
| 2,642,105 | 6/1953 | Alliano | 81/901 X |
| 2,909,090 | 10/1959 | Moore | 81/176.15 |
| 3,086,414 | 4/1963 | Nardi . | |
| 3,742,533 | 7/1973 | Brunette . | |
| 3,812,894 | 5/1974 | Bradbury . | |
| 4,562,758 | 1/1986 | Stirling | 81/124.2 X |
| 4,685,360 | 8/1987 | McCurdy . | |
| 4,823,650 | 4/1989 | Tuttle . | |
| 4,836,065 | 6/1989 | Setliff | 81/124.2 |
| 4,875,395 | 10/1989 | Alvarez . | |
| 5,048,378 | 9/1991 | Nikolas | 81/176.15 X |
| 5,287,775 | 2/1994 | Moore . | |

FOREIGN PATENT DOCUMENTS

| | | |
|---|---|---|
| 0087630A2 | 9/1983 | European Pat. Off. . |
| 0087630B1 | 9/1983 | European Pat. Off. . |

*Primary Examiner*—James G. Smith
*Attorney, Agent, or Firm*—Chase & Yakimo

[57] ABSTRACT

A socket for driving a wing nut or the like comprises a cylindrical housing having a bore at one end for receiving the wing nut therein. A port at the opposed end of the housing receives the end of a shank of a driving tool such as a ratchet or the like. First and second pairs of radially offset slots are positioned within the housing and about the bore, the slots having relatively different widths and/or lengths. Upon insertion of a wing nut within the bore, the wings thereof extend through the opposed slots of a pair of slots. The relatively-sized widths and/or lengths of the first and second pairs of slots enable a wide range of wing nuts to be driven by one socket.

3 Claims, 5 Drawing Sheets

WING NUT DRIVER

BACKGROUND OF THE INVENTION

This invention relates to a socket wrench and, more particularly, to a socket wrench for driving a plurality of relatively sized wing nuts or the like.

The use of socket wrenches for fastening and unfastening nuts is known. Accordingly, such sockets are made of various sizes so as to fit a range of differently sized nuts. It is thus desirable to have sockets which can install and/or release wing nuts, without the need to invest in a plurality of sockets for engaging a range of variously-sized wing nuts. One wing nut socket is shown in the Nardi patent U.S. Pat. No. 3,086,414. However, the Nardi device is designed for only one size of wing nut and not for the use of one socket with variously sized and/or types of wing nuts.

In response thereto we have invented a socket for use with a wide range of wing nuts, the socket wrench including first and second paired slots, each slot pair having relatively different slot lengths and/or widths. The use of the relatively sized slots enables differently sized wing nuts to be handled by one corresponding socket. The sockets are designed for use with existing manual wrenches, handles and/or low torque, multi-speed drills.

Accordingly, it is an object of this invention to provide a socket wrench for driving wing nuts or the like.

Another particular object of this invention is to provide a socket wrench, as aforesaid, which will drive wing nuts of relatively different sizes and/or types.

A further object of this invention is to provide a socket wrench, as aforesaid, having at least first and second pairs of opposed slots of different configurations for driving different wing nuts.

A further object of this invention is to provide a socket wrench, as aforesaid, which is adaptable for use with wrenches, handles and drills.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
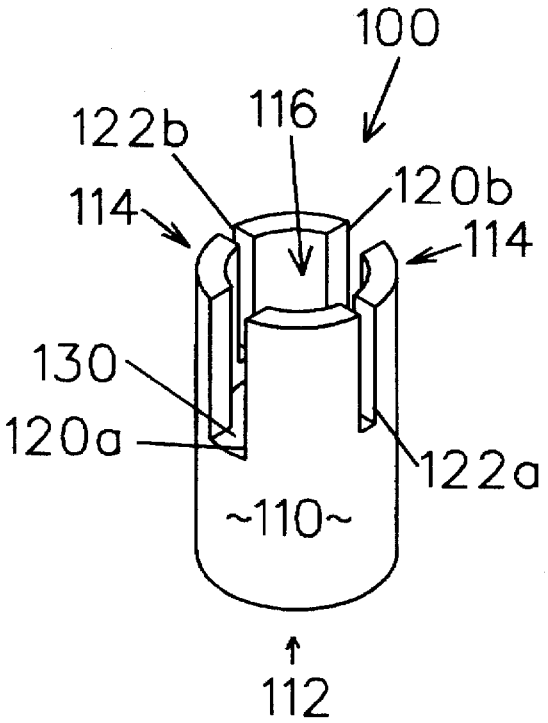
FIG. 1 is a perspective view of a first embodiment of the socket/wing nut driver.
Figure 2:
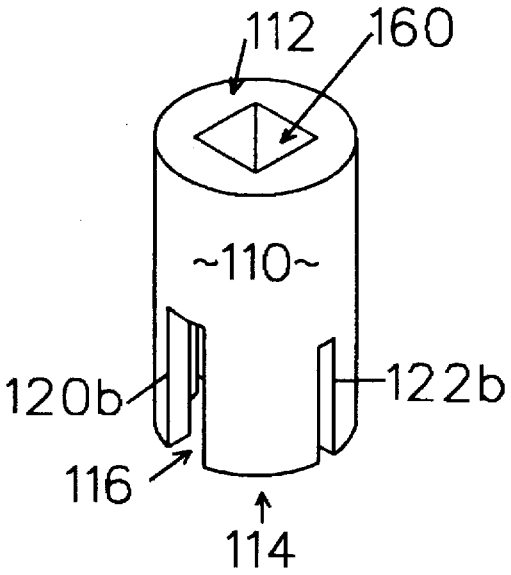
FIG. 2 is a perspective view of the socket in FIG. 1 from the opposed end thereof.
Figure 3:
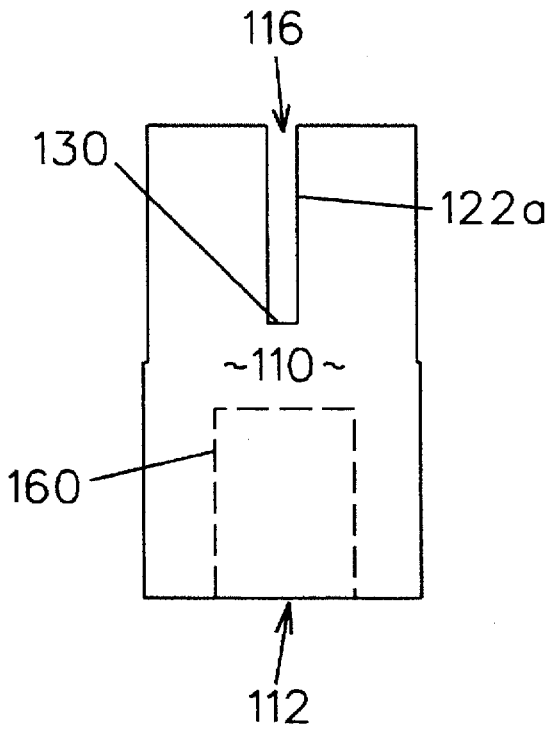
FIG. 3 is an elevation view of the socket of FIG. 1 and showing in phantom lines the driver connection port.
Figure 4:
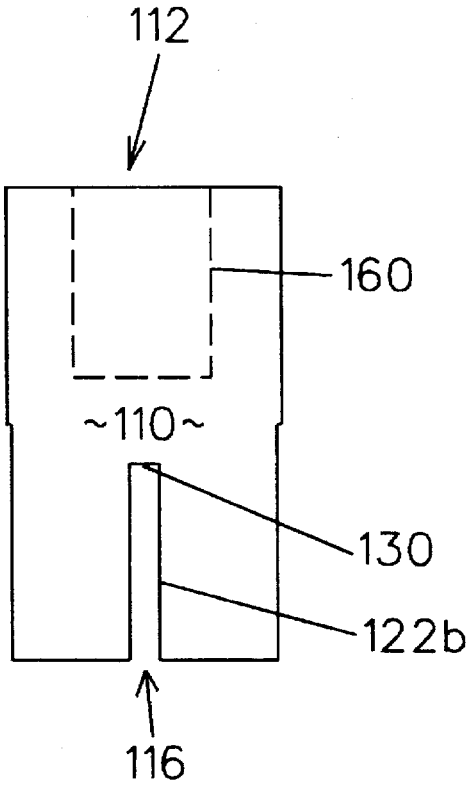
FIG. 4 is a view of the socket of FIG. 3 rotated 180° about the horizontal.
Figure 5:
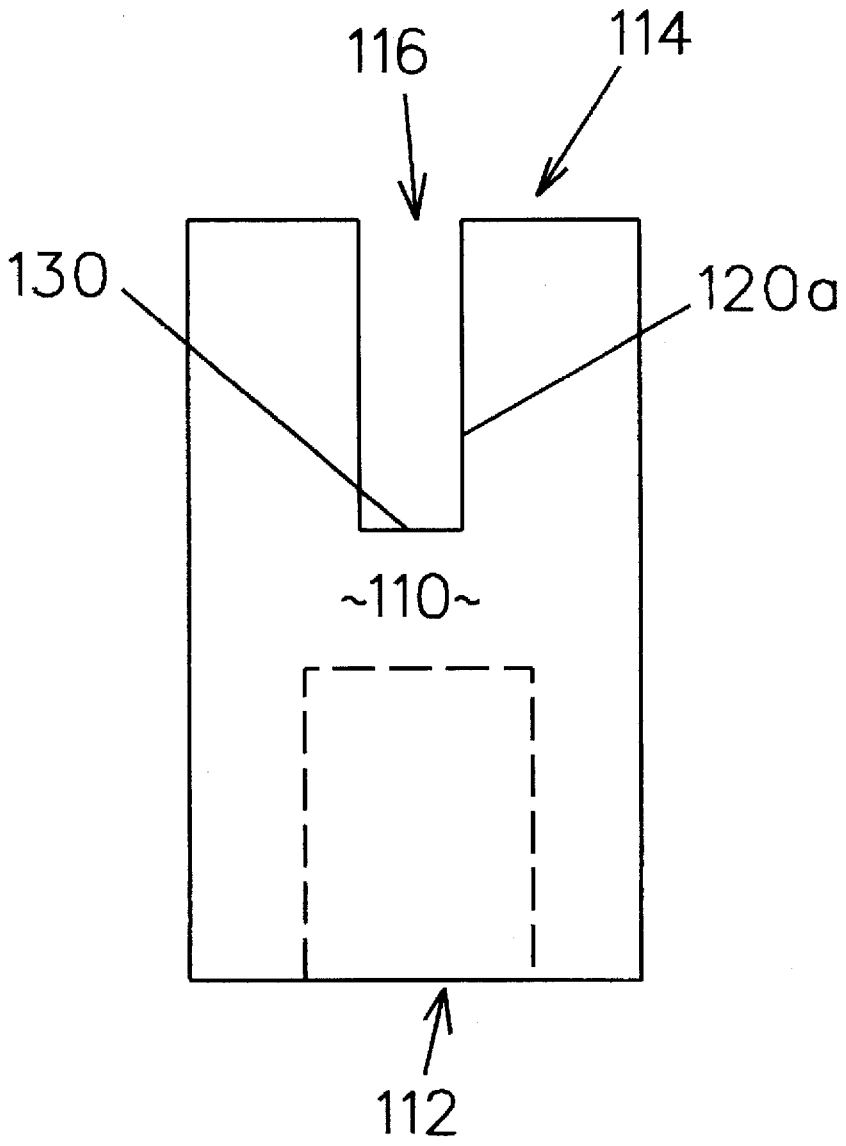
FIG. 5 is an elevation view of the socket of FIG. 1 rotated 90° to show one slot of a second pair of opposed slots.
Figure 6:
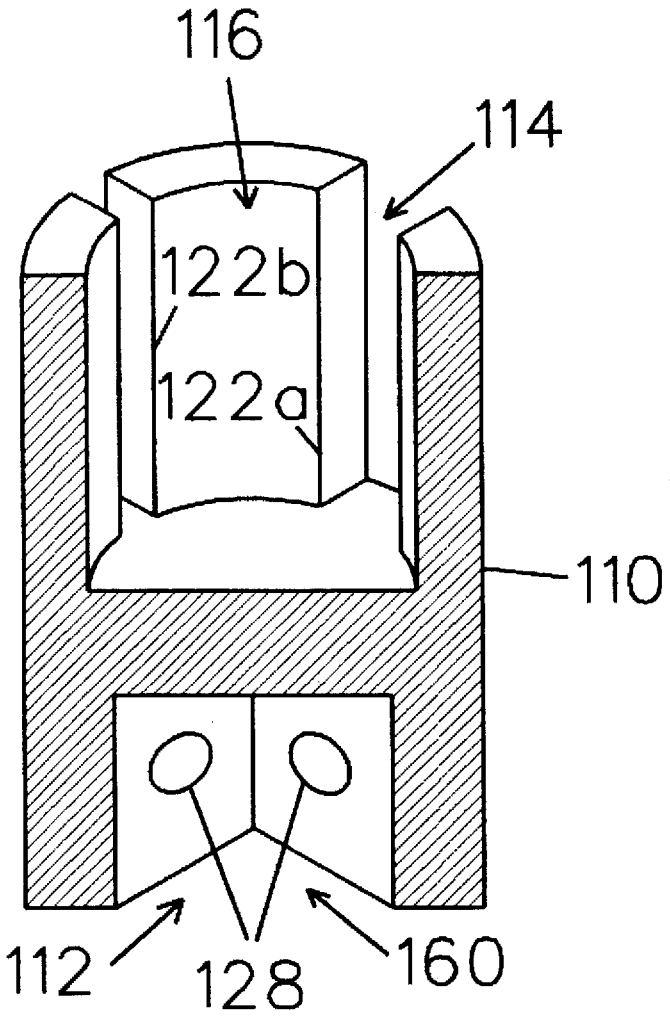
FIG. 6 is a sectional view of the socket wrench of FIG. 1 taken along the longitudinal centerline thereof.

Turning more particularly to the drawings, FIG. 1 shows a first embodiment of our socket wrench 100 as comprising a cylindrical housing wall 110 having a first handle end 112 and an opposed driver end 114.

The driver end 114 includes a central cylindrical bore 116 surrounded by the interior surface of the housing wall 110. Located in the housing wall 110 are first and second pairs of opposed slots **120*a*, 120*b*, 122*a*, 122*b*, the paired slots located at opposed ends of a diameter normally passing through the imaginary vertical centerline of the bore 116. The slots are preferably radially spaced 90° one from the other relative to the imaginary vertical centerline extending through bore 116. Each slot has an open end adjacent one end of housing wall 110 and an opposed closed end at a horizontal wall 130 which defines one end of the bore 116. As shown, the first pair of slots 120*a*, 120*b* are larger in width than the second pair of slots 122*a*, 122*b***.

At the opposed end of the housing wall 110 of socket 100 is the driver end 114 having a connection port 160 therein. The connection port 160 is configured to receive various types of socket drivers therein, such as handle, drill shank, ratchet shank, etc. Detents 128 are located in the port 160 walls to receive the lugs found on the end of the various shanks.

Figure 7:
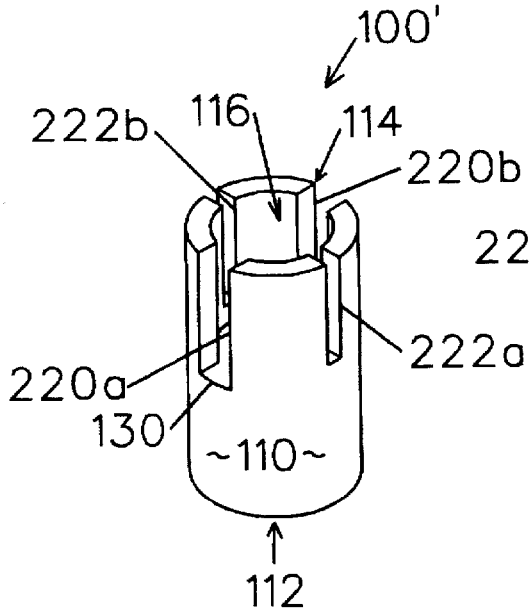
FIG. 7 is a view of a second embodiment of the socket wrench having first and second pairs of slots of different widths and lengths.
Figure 8:
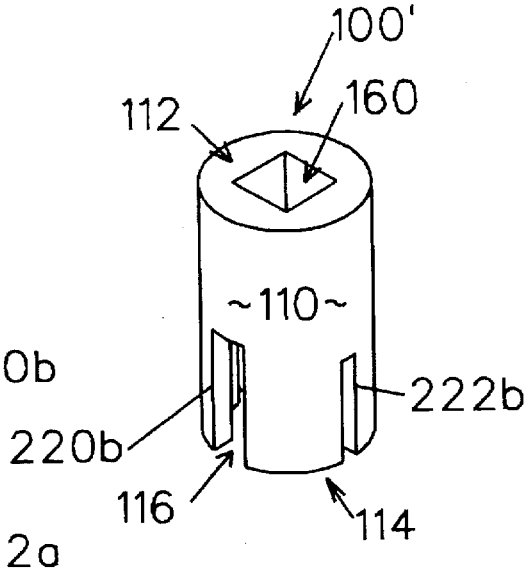
FIG. 8 is a view of the socket of FIG. 7 from the opposed end thereof.

An alternative embodiment 100' is shown in FIG. 7. This embodiment 100' is similar to the construction of embodiment 100 except that the first **220*a*, 220*b* and second 222*a*, 222*b* pairs of slots are not only of relatively different widths but are also of relatively different lengths. This relationship further accommodates the various sizes and/or types of wing nuts and wings extending therefrom that may be driven by the socket 100'**.

Figure 9:
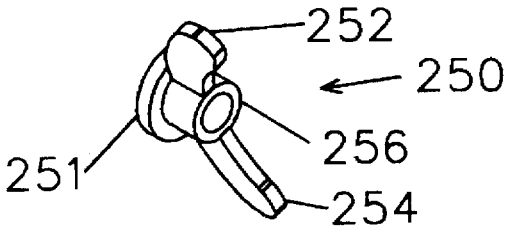
FIG. 9 is a perspective view of one type of wing nut for use in the FIG. 1 and FIG. 7 sockets.

The slot pairs, as above described, are adapted to receive the wing extensions 252, 254 of a wing nut 250 therethrough, one such wing nut being shown in FIG. 9. As such, the top 251 of the drive head 256 of the wing nut rests on the wall 130 with the wings 252, 254 then extending through the opposed slots of a pair of slots. Due to the relative widths and/or lengths between the first and second pairs of slots, various types and/or sizes of wing nuts may be fitted within the bore 116 so that the wings extend through either the first or second pairs of opposed slots. The slot pair selected will depend on the size and/or type of the wing nut to be driven. Due to the friction fit between the wings of the nut and the slots, the wing nut is held within the bore 116 prior to bolt engagement. Accordingly, depending on the size and/or type of the wing nut and/or wing sections thereof, either the first pair or second pair of slots will be utilized.

It is understood that the sockets 100, 100' may be adaptable for use with other nuts, i.e. in some cases the corners of square nuts may fit within the opposed slots. Also, it is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A socket for driving a wing nut, the wing nut having a bolt-engaging head with first and second opposed wings extending from the head, said socket comprising:

a housing having first and second opposed ends;

a bore extending through said housing and presenting an aperture at said first housing end, said bore surrounded by said housing;

a port at said second opposed end of said housing for receiving a shank end of a socket driver therein;

a first pair of opposed slots in said housing and along said bore, said first pair of slots being at opposed ends of an imaginary diameter normally passing through an imaginary vertical centerline of said bore, each of said first pair of slots comprising:

a pair of walls extending from said first housing end and towards said second housing end, said walls spaced apart at a distance adapted for a friction fit of a wing of a first wing nut therebetween upon insertion of a bolt engaging head of the first wing nut into said bore;

a second pair of opposed slots in said housing and along said bore, said second pair of slots being at opposed ends of a second imaginary diameter normally passing through an imaginary vertical centerline of said housing, each of said second pair of slots comprising:

a pair of walls extending from said first housing end and towards said second housing end, said walls having a length greater than said walls of said first pair of slots and spaced apart at a greater distance than said walls of said first pair of slots, said walls of said second pair of slots adapted for a friction fit of a wing of a larger second wing nut therebetween upon insertion of a bolt engaging head of the second wing nut into said bore;

a wall separating said port and said bore, said bore adapted to receive the bolt-engaging head of the first or second wing nut therein with the wings of the respective wing nut extending through said slots of said first or second pairs of slots, said wings engaging the respective walls of said respective slots in said friction fit to retain the wing nut within the bore prior to engagement of the head of the wing nut with a bolt.

2. The socket as claimed in claim 1 wherein said slots of said first pair of slots are offset 90° relative to said slots of said second pair of slots.

3. A socket for driving a wing nut, the wing nut having a bolt-engaging head with first and second wings extending from the head, said socket comprising:

a housing having first and second opposed ends;

a bore extending through said housing and presenting an aperture at said first housing end, said bore surrounded by said housing;

a port at said second opposed end of said housing for receiving a shank of a socket driver therein;

a first pair of first and second opposed slots of a first width and length in said housing and along said bore;

a second pair of third and fourth opposed slots in said housing and along said bore, said third and fourth opposed slots of a second different width and length relative to said width and length of said first and second slots in said housing, said bore configured to receive a bolt-engaging head of first or second relatively sized wing nuts therein with each pair of said opposed slots configured to receive first and second wings of one of the wing nuts in respective extension through said opposed slots, the wings retained within said opposed slots prior to engagement of one of the wing nuts with a bolt by means of a friction fit engagement therein.

* * * * *